United States Patent [19]

Welker

[11] 4,379,564

[45] Apr. 12, 1983

[54] ROLLER SKATE

[76] Inventor: John J. Welker, 1904 LaFontenay Ct., Louisville, Ky. 40223

[21] Appl. No.: 337,630

[22] Filed: Jan. 7, 1982

Related U.S. Application Data

[63] Continuation of Ser. No. 75,699, Sep. 14, 1979, abandoned.

[51] Int. Cl.[3] ..... A63C 17/14

[52] U.S. Cl. ..... 280/11.2; 280/11.27; 280/11.3

[58] Field of Search ..... 280/11.19, 11.2, 11.3, 280/11.27, 11.28, 11.26, 87.04 A

[56] References Cited

U.S. PATENT DOCUMENTS

| | | | |
|---|---|---|---|
| 1,345,848 | 7/1920 | Hardy | 280/11.26 |
| 1,406,642 | 2/1922 | Hardy | 280/11.19 |
| 2,150,814 | 3/1939 | Barbato | 280/11.27 |
| 3,086,787 | 4/1963 | Wyche | 280/11.19 |
| 3,180,651 | 4/1965 | Ware | 280/11.2 |
| 3,235,282 | 2/1966 | Bostick | 280/11.26 X |
| 3,771,811 | 11/1973 | Bueho | 280/87.04 A |
| 4,062,557 | 12/1977 | Roden | 280/11.27 X |

FOREIGN PATENT DOCUMENTS

| | | | |
|---|---|---|---|
| 422127 | 3/1911 | France | 280/11.27 |

*Primary Examiner*—Joseph F. Peters, Jr.
*Assistant Examiner*—Michael Mar
*Attorney, Agent, or Firm*—Charles G. Lamb

[57] ABSTRACT

A roller skate having improved means for holding a shoe to a roller skate, the means including a flat plate member provided with a plurality of slots on opposed sides thereof for receiving a belt or strap therethrough wherein the belt or strap securely holds a shoe to the plate member.

7 Claims, 3 Drawing Figures

ROLLER SKATE

This is a continuation of application Ser. No. 075,699, filed Sept. 14, 1979, now abandoned.

BACKGROUND OF THE INVENTION

This invention relates to an improved roller skate. In one aspect, the invention relates to an improved means for holding a shoe to a roller skate. In another aspect, the invention relates to improved means for positioning the rollers of a roller skate for improved roller skateability.

In recent years there has been considerable activity in the use of roller skates for transportation and recreation. In fact, in some parts of the country, particularly California, boardwalks have been provided specifically for use by roller skaters. Most of the skaters utilizing these boardwalks use roller skates which have shoes fixidly attached to the skate member which are in most instances cumbersome to carry around or pack whenever one is in an area wherein the skates are not usable. In regards to this, there exists a need for a skate which is adaptable for receiving a shoe thereon and is not particularly cumbersome to carry around when not in use. Furthermore, the softness of present day footwear dictates a fastening method which most securely holds the foot rather than the shoe. In the prior art, U.S. Pat. No. 834,526 teaches a roller skate with straps or belts for holding a shoe to a base plate wherein the base plate has slots therein for receiving the straps therethrough. However, only two opposed slots are provided for receiving or making a loop at the toe portion of the shoe. This does not give adequate support nor is it easily adjustable for various sizes of shoes so the shoe will be securely fastened therein. U.S. Pat. No. 323,135 teaches a roller skate including a base plate with means to receive a shoe thereon and specifically teaches upwardly extending members on the front and back portions of the skate with slots therein to receive belts or straps therethrough for securing a shoe to the base plate. However, easy adjustability and securing of a shoe to the plate member is difficult.

SUMMARY OF THE INVENTION

In the present invention it is recognized that it is desirable to provide an improved roller skate. It is further recognized that it is desirable to provide a roller skate adaptable for receiving street shoes thereon. It is also recognized that it is desirable to provide a roller skate which is comfortable and safe.

The present invention advantageously provides a straight forward arrangement for an improved roller skate adapted for receiving a street shoe thereon. The present invention further advantageously provides a roller skate with strapping means thereon for receiving and securely attaching shoes of various sizes thereon. Moreover, the present invention advantageously provides a roller skate with rollers positioned for improved skateability.

Various other features of the present invention will become obvious to those skilled in the art upon reading the disclosure set forth hereinafter.

More particularly, the present invention provides a roller skate comprising a foot-plate member having at least two pairs of slots on the toe portion thereof, each pair of slots being aligned and on opposite sides of the member receiving a first adjustable belt therethrough, the member including means on the heel portion receiving a second adjustable belt; and, a first pair of aligned spaced rollers mounted to the underside of the toe portion of the foot-plate member and a second pair of aligned spaced rollers mounted to the underside of the heel portion of the member.

It is to be understood that the description of the example of the present invention given hereinafter are not by way of limitation. Various modifications within the scope of the present invention will occur to those skilled in the art upon reading the disclosure set forth hereinafter.

Referring to the drawings.

Figure 1:
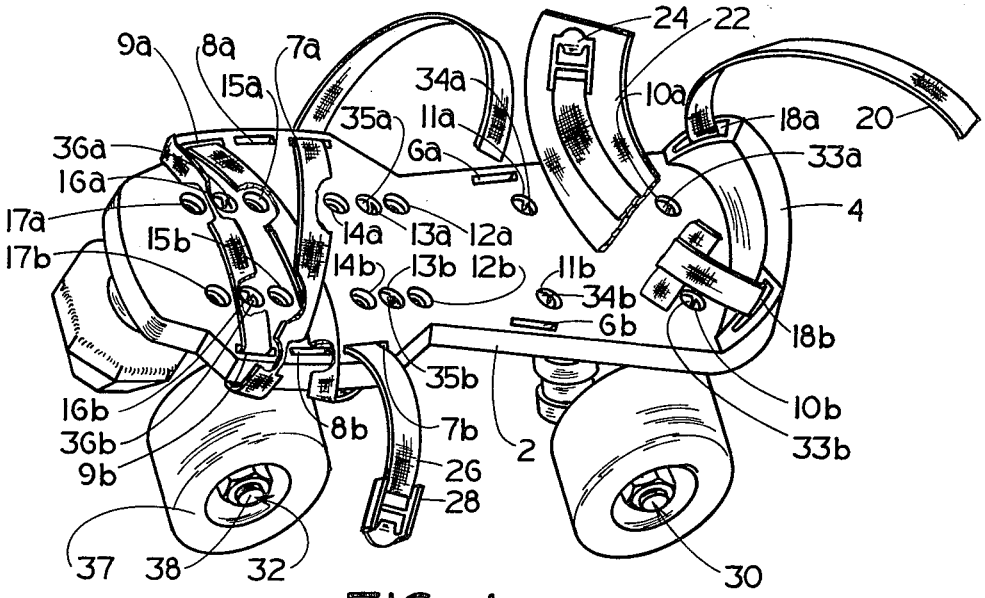
FIG. 1 is a perspective view of a preferred roller skate of the present invention with selected portions cut away.
Figure 2:
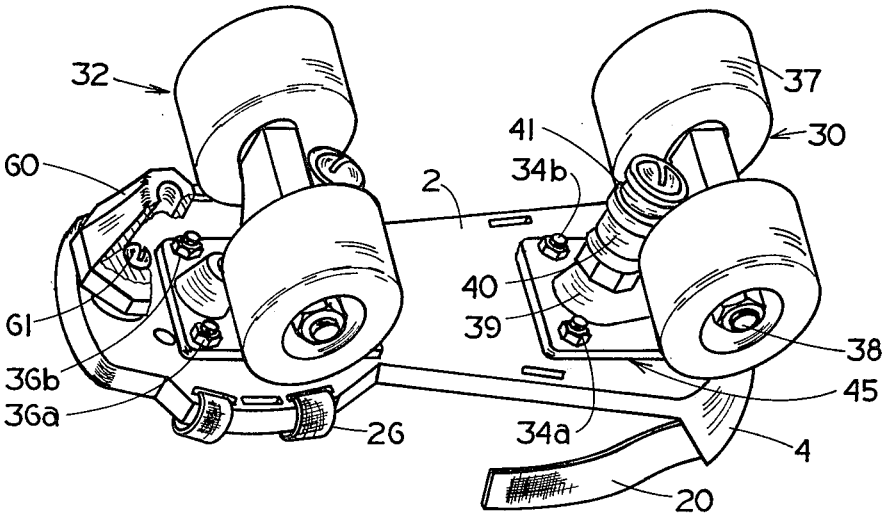
FIG. 2 is a perspective view of the underside of the roller skate of FIG. 1; and, FIG. 3 is a plan view from the underside of another preferred embodiment of the present invention.

In the drawings, the roller skate as shown in FIGS. 1 and 2 includes a foot-plate member 2 having an upwardly extending portion 4 along the perimeter of the back portion for receiving a heel of a shoe (not shown) therein. The foot-plate member 2 is also provided with at least two pairs of slots on the toe portion thereof, each pair of slots being aligned and on opposite sides of the foot-plate member. In the example, four pairs of slots are shown, one pair identifiable by the numerals **6*a* and 6*b* being intermediate of member 2 with slots identifiable by numerals 7*a* and 7*b*, 8*a* and 8*b*, 9*a* and 9*b*, respectively, being in the toe portion of member 2, slots 6*a* and 6*b* being aligned on opposite sides of the plate member 2 as well as slots 7*a* and 7*b*, and 8*a* and 8*b*, and 9*a* and 9*b*. Aligned mounting apertures are also provided in the foot-plate member 2 for mounting rollers to the underside of the foot-plate member 2. At the heel portion of the member 2 are two pair of aligned mounting apertures for a rear roller assembly 30 identifiable by the numerals 10*a* and 10*b*, and 11*a* and 11*b*. At the toe portion of the member 2, six pairs of spaced aligned apertures for mounting a front roller assembly 32 are also provided and identifiable by the numerals 12*a* and 12*b*, 13*a* and 13*b*, 14*a* and 14*b*, 15*a* and 15*b*, 16*a* and 16*b*, and 17*a* and 17*b*, respectively. Using six pairs of aligned apertures enables three different mounting positions for roller assembly 32 thereby enabling the user to position the roller assembly 32** substantially under the ball of the foot of the user.

In the upwardly extending portion 4 of the member 2 is a pair of opposed slots identifiable by the numerals **18*a* and 18*b*. Slots 18*a* and 18*b* are disposed for receiving an ankle belt 20 therethrough. Ankle belt 20 is provided with a buckle 24 for adjustable attachment of the strap 20 around the ankle of the wearer. Also provided is a flexible comfort pad member 22, pad 22 having slots therein at each end thereof to receive belt 20 therethrough. However, pad 22** may be sewn or attached by any other well known means.

A toe strap 26 having an appropriate buckel 28 thereon passes up through selected aligned pairs of slots exemplified as slots **7*a* and 7*b* and 9*a* and 9*b*, for securely holding the toe portion of a shoe thereon. Strap 26** is disposed in a criss-cross fashion for maximum support and adjustability. It is realized that other configurations for the strap system may be used without departing from the scope and spirit of the invention.

Mounted to the underside of the foot-plate member 2 at each end thereof is the roller assemblies 30 and 32, roller assembly 30 being disposed at the rear or heel portion of the skate and roller assembly 32 being at the front or toe portion of the skate. In FIGS. 1 and 2, the roller assemblies 30 and 32 are identical. The roller assembly 30 is mounted to the underside of the foot-plate member 2 with fastening members 33*a* and 33*b* in the rear portion and 34*a* and 34*b* in the front portion whereas roller assembly 32 is mounted with fastening members 35*a* and 35*b* in the rear and fastening members 36*a* and 36*b* in the front. Attaching of the roller assembly 32 at mounting apertures 13*a* and 13*b* in the rear and 16*a* and 16*b* in the front may be changed depending upon the desired positioning by the wearer. This is particularly important for the assembly 32 as maximum speed, comfort, and security are obtained when the rollers are disposed substantially beneath the ball of the foot of the wearer.

Each of the roller assemblies includes a pair of spaced rollers 37 which are rotatively mounted to the axle 38 of a truck assembly 45. Truck assembly 45 includes a support portion 39 centrally disposed of the axle 38 and extends transversely therefrom. The support portion 39 includes an elongated bolt member 40 with "o" ring shaped cushioning members 41 disposed therealong for absorbing the shock of the skate during use and allows pivotability when the skater turns. It is realized that truck assemblies are well known in the art and any others may be utilized without departing from the scope of the invention.

A toe stop 60 attached by any well known means, such as fastening device 61, is also provided. The preferred toe stop 60 is made of an abrasion resistant material and is mounted perpendicular to the foot-plate member 2. By positioning the toe stop 60 in this manner, the vertical side surfaces of the stop 60 are subjected to wear as opposed to the bottom surface which is generally used. As shown, toe stop 60 has eight-sides thereby increasing the wear life over conventional, or the presently accepted toe stop, which has only one surface for wear. However, it is realized that other toe plates may be used without departing from the scope and spirit of the present invention.

Figure 3:
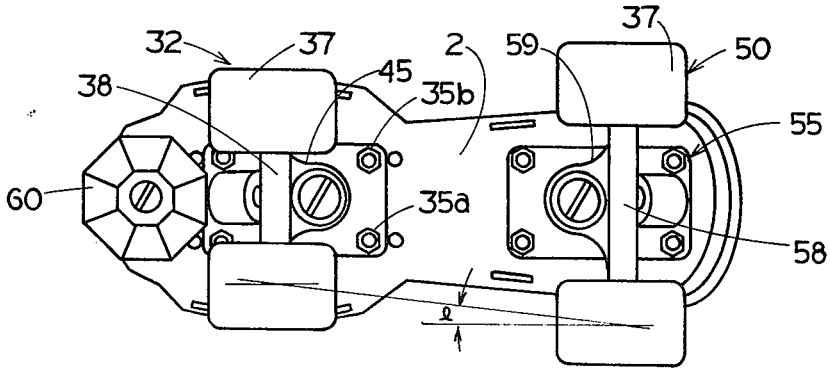

In FIG. 3, roller assemblies having different axle lengths are shown. By increasing the spacing between the rollers 37 on a rear roller assembly 50, rear rollers 37 are disposed in angular alignment with front rollers 37 as designated by the angle $\alpha$. For speed skaters this angular alignment of rollers enables the skater to push with his foot with less turning of the ankle than when using skates where the front and rear rollers are aligned with the spacings between the rollers on the rear and those on the front being substantially the same. To achieve and sustain forward motion, skaters must turn their ankles, setting their toes outside their directional line of travel to provide a base to propel themselves forward. This movement consumes energy. By adapting an angular arrangement, as shown, a skater can more easily achieve his propulsion base. With the ankle turned less, more of the skater's energy ca be devoted to forward propulsion and greater speed is achieved.

In the roller assembly 50 a pair of spaced rollers 37 are rotatively mounted to the axle 58 of a truck assembly 55. Truck assembly 55 includes a support portion 59 centrally disposed of the axle 58 and extends transversely therefrom. The support portion 59 includes an elongated bolt member (not shown) with "o" ring shaped cushioning members (not shown) disposed therealong for absorbing the shock of the skate during use in the same manner as truck assembly 45 discussed hereinbefore.

The foot-plate member 2 may be any conventional material used for roller skates and is preferably a plastic reinforced with fiber-glass. The strap system on the toe portion of the member 2 can be created for a custom fit for the particular foot or toe portion of a shoe which is received. Preferably a criss-cross lacing pattern provides for a more secure and comfortable fit. Also, the pad 22 which is used in combination with the strap 20 for adding comfort to the wearer, is generally a flexible nylon.

It is realized that various changes may be made to the specific embodiments shown and described without departing from the principles and spirit of the present invention.

What is claimed is:

1. A roller skate comprising:

a foot-plate member with a toe portion and a heel portion having at least two pairs of slots in said toe portion thereof, each pair of slots being aligned and on opposite sides of said member receiving a first adjustable belt therethrough, said member including means on said heel portion receiving a second adjustable belt therethrough; and, a first front pair of aligned spaced rollers rotatively mounted to a first axle of a first truck assembly including a support portion centrally disposed of said first axle and extending transversely from the underside of said toe portion of said member and a second rear pair of aligned spaced rollers rotatively mounted to a second axle of a second truck assembly, said second truck assembly including a support portion centrally disposed of said second axle and extending transversely from the underside of said heel portion of said member, spacing between rollers of said first pair of spaced rollers is less than the spacing between rollers of said second pair of rollers, the center of the tread of each of said rollers of said first pair of rollers being in substantially longitudinal alignment with the inside edge of each of said rollers of said second pair of rollers which are on the same side of said member, said first pair of rollers and said second pair of rollers being of substantially the same size and diameter whereby the first and second axles swing in use in opposite directions to enable steering of said roller skate by tilting of the foot plate member.

2. The roller skate of claim 1 wherein said first adjustable belt is in a criss-cross lacing pattern.

3. The roller skate of claim 1 wherein said heel portion includes an upwardly extending portion with slots therein receiving said second adjustable belt therethrough.

4. The roller skate of claim 1 wherein said toe portion of said member includes a plurality of spaced pairs of mounting apertures therein whereby said first pair of aligned spaced rollers may be mounted at a plurality of preselected positions.

5. The roller skate of claim 1 including a pair of opposed slots in said foot-plate member between said toe portion and said heel portion, said opposed slots for receiving adjustable belt therethrough.

6. The roller skate of claim 1 including a toe-stop mounted perpendicular to the underside of the toe portion of said flat-plate member.

7. The roller skate of claim 6, said toe-stop having a plurality of wear surfaces thereon.

* * * * *